US005213332A

United States Patent [19]

Fahy et al.

[11] Patent Number: 5,213,332

[45] Date of Patent: May 25, 1993

[54] GOLF PUTTER

[76] Inventors: William J. Fahy; Jane L. Fahy, both of 128 Oklahoma Ave., Oriskany, N.Y. 13424

[21] Appl. No.: 913,886

[22] Filed: Jul. 17, 1992

[51] Int. Cl.[5] ..... A63B 69/36; A63B 53/04

[52] U.S. Cl. ..... 273/187.4; 273/175; 273/169; 273/164.1

[58] Field of Search ..... 273/175, 167 J, 163 R, 273/162 R, 171, 187.4, 186.2, 164.1

[56] References Cited

U.S. PATENT DOCUMENTS

| | | | |
|---|---|---|---|
| 837,030 | 11/1906 | Blanchard | 273/163 A X |
| 3,759,527 | 9/1973 | Witherspoon | 273/171 |
| 3,989,257 | 11/1976 | Barr | 273/175 |
| 4,121,833 | 10/1978 | Prueter | 273/175 |
| 4,725,062 | 2/1988 | Kinney | 273/175 |
| 4,964,639 | 10/1990 | Tucker | 273/164 |
| 5,125,664 | 6/1992 | Evans | 273/163 R X |

*Primary Examiner*—George J. Marlo
*Attorney, Agent, or Firm*—Larson & Taylor

[57] ABSTRACT

A golf putter having a front driving face which is convexly curved with a radius of curvature between 5½ and 12 inches eliminates errors due to the misalignment of the putter face to the correct line of the putt. The golf putter further includes a directional alignment aid to assist the golfer in setting up the correct line of the putt and hold the putter in balance so that it will stand alone when placed upright.

10 Claims, 3 Drawing Sheets

GOLF PUTTER

FIELD OF THE INVENTION

The present invention is generally related to a golf putter and, more particularly, to a new and improved golf putter which eliminates the error associated with perpendicular misalignment of a flat putter face to the line of the putt.

BACKGROUND OF THE INVENTION

The game of golf requires that the players possess the skill of hand to eye coordination. In particular, a high degree of accuracy is required when putting the ball. The accuracy of a golfer's putt is primarily dependent upon three factors. First, the golfer must determine the correct line of travel of the ball to an intended target. This requires that the golfer set up an imaginary line from the ball to the hole, referred to as the correct line of the putt. Second, the golfer must ensure that the putter face is perpendicular to the correct line of the putt. If the putter face is not positioned in this manner, the ball will travel at an angle away from the hole. Consequently, even a slight twisting of a golf putter away from the proper position can result in a missed putt. This is particularly frustrating to the golfer who has a natural tendency to turn his wrists during the swing, or the golfer who has difficulty discerning a slight rotation away from perpendicularity. Finally, the golfer must strike the ball with the correct force to propel it to the hole.

Errors associated with any one of these three factors can result in a missed putt. However, the accuracy of a golfer's putt is particularly sensitive to very small changes in the angle of the putter face to the correct line of the putt. FIG. 1 shows that a golf ball travels perpendicular (at an angle of 90°) to the position 34, 34' of the putter face when hit with a conventional flat putter face. Thus, to avoid missing the putt, the golfer must align the putter face 34 essentially perfectly perpendicular to the correct line of the putt 31. A slight rotation, $\theta$, of the putter face from position 34 to position 34' will direct the ball away from the hole in line of travel 35.

The table shown in FIG. 2 provides a comparison of the potential offset x of the ball from the hole when hit by a putter face which is not perpendicular to the correct line of the putt. An offset of greater than about 1.5 inches is considered a miss. The offsets created by changing the angle $\theta$ in half degree increments is shown in the table columns. Where $\theta$ is 1.5 degrees or more, the hole will be missed at a putt distance as close as 5 feet. Similarly, a review of the offsets at putt distances ranging from 5 to 30 feet shows that the effect of non-perpendicularity becomes more significant as putt distance is increased. For example, at a putt distance of 15 or more feet, a half degree rotation from perpendicularity creates enough offset to cause a missed putt. Similarly, if the variation in perpendicularity is 1.5 degrees or more, the hole will be missed at a putt distance as close as 5 feet.

Changes in the perpendicularity of the putter face to the correct line of the putt typically occur for two reasons. First, a golfer's stance during putting is generally such that his or her eye level is three to four feet above the ball. From this height, it is difficult to judge whether or not the putter face is perpendicular to the correct line of the putt. Moreover, the ability to discern a few degrees change from perpendicularity is difficult, if not impossible, for some golfers. Second, even if the golfer is able to align the putter face perpendicular to the correct line of the putt, non-perpendicularity often results due to movement of the golfer's wrists at the moment of impact in his or her swing.

Others have previously attempted to utilize curvature in the design of the driving face of the putter to compensate for variations in the angle of the putter face to the line of the putt. U.S. Pat. No. 3,989,257 to Barr discloses a putter which is directed to correcting the problem of slight wrist movements on the part of the golfer at the moment the putter impacts the golf ball. Barr compensates for angular rotation of the putter by designing the driving face as a convex horizontal curve approximating an ellipse, possibly with a convex vertical curve approximating a second ellipse. However, such a design is believed to be relatively complex and therefore difficult to construct and utilize.

U.S. Pat. No. 4,121,833 to Prueter is also directed to a golf putter which utilizes a curved driving face in an attempt to enhance directional accuracy in spite of inadvertent twisting of the face of the putter during the stroking operation. Preuter's striking surface has the general configuration of a cylindrical segment of substantially constant radius. However, in Preuter, the radius of curvature from the axis of the shaft engaging zone to the striking surface is very small, namely between 2½ and 4½ inches. However, such a short radius of curvature significantly increases the chance of error if the putter is moved in a line other than the correct line to the target.

Thus, the need exists to provide an improved putter, which utilizes the concept of a curved driving face, which more effectively compensates for golfer error and thereby enhances the accuracy of the putting stroke.

SUMMARY OF THE INVENTION

Thus, the purpose of the present invention is to overcome the disadvantage of the prior art and thereby provide a putter which reduces the chance of error associated with putting a golf ball.

This purpose of the present invention is achieved by providing a golf putter in which the front driving face of the putter head is convexly curved along the arc of a circle. In a preferred embodiment, the radius of curvature is 5½–12 inches, which is sufficient to provide a single point of contact of the putter to the ball rather than a flat surface, but not so small that a slight deviation in the direction of the putting stroke from the line of the putt would create significant error. Once the correct line of the putt is set, the front driving face can be rotated and, assuming that the putting stroke moves in the correct direction along the line of the putt, the ball will still travel in the correct line of the putt, rather than at an angle. The putter of the present invention may further include a directional alignment aid which extends outward from the rear face of the putter head and assists the golfer in determining the correct line of the putt. The golf putter is readily manufactured from various materials, using any number of conventional methods of construction. In addition, the putter head is adaptable to receive any type of shaft which is designed to extend upward from a position on the top surface of the putter head.

It is therefore an object of the present invention to provide a golf putter which eliminates the effect of the driving face being non-perpendicular to the correct line of the putt.

It is a further object of the present invention to provide a golf putter which facilitates the golfer in determining the correct line of the putt.

These and other objects of the present invention will become apparent from the detailed description to follow.

BRIEF DESCRIPTION OF THE DRAWINGS

There follows a detailed description of the preferred embodiments of the present invention which are to be taken together with the accompanying drawings, wherein.

DETAILED DESCRIPTION OF THE PREFERRED EMBODIMENTS

Referring now to the figures, like elements are represented by like numerals throughout the several views.

Figure 1:
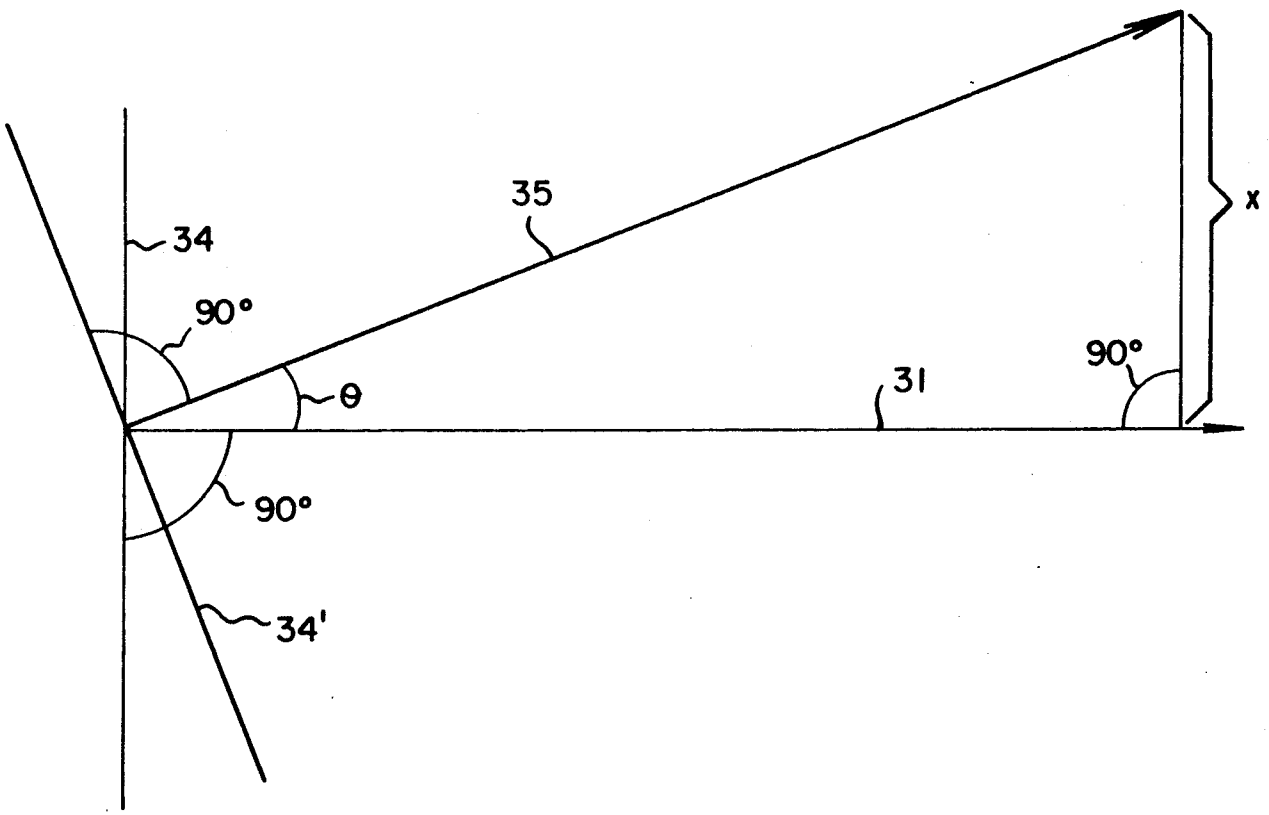
FIG. 1 (PRIOR ART)
FIG. 1 shows the direction a golf ball travels when hit with a conventional flat putter face.
Figure 2:
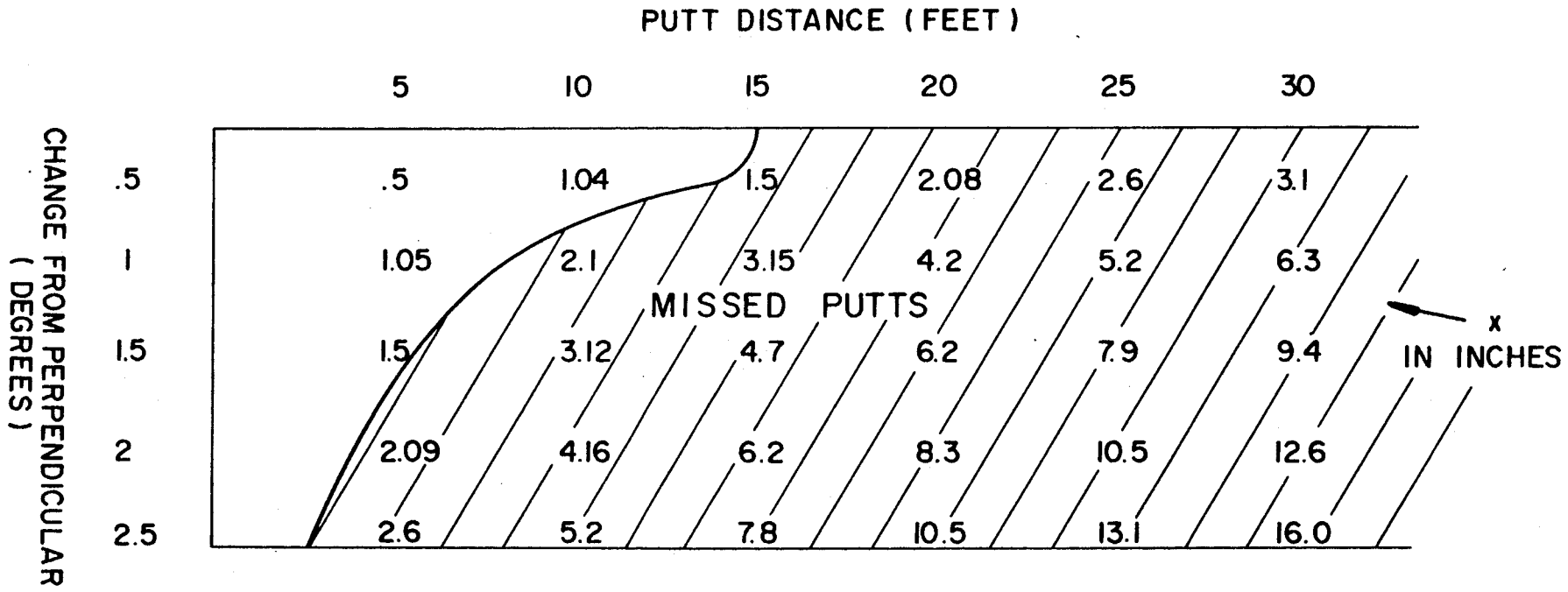
FIG. 2 is a table showing a comparison of the potential offset of the ball from the hole when hit by a putter face which is not perpendicular to the correct line of putt.
Figure 3:
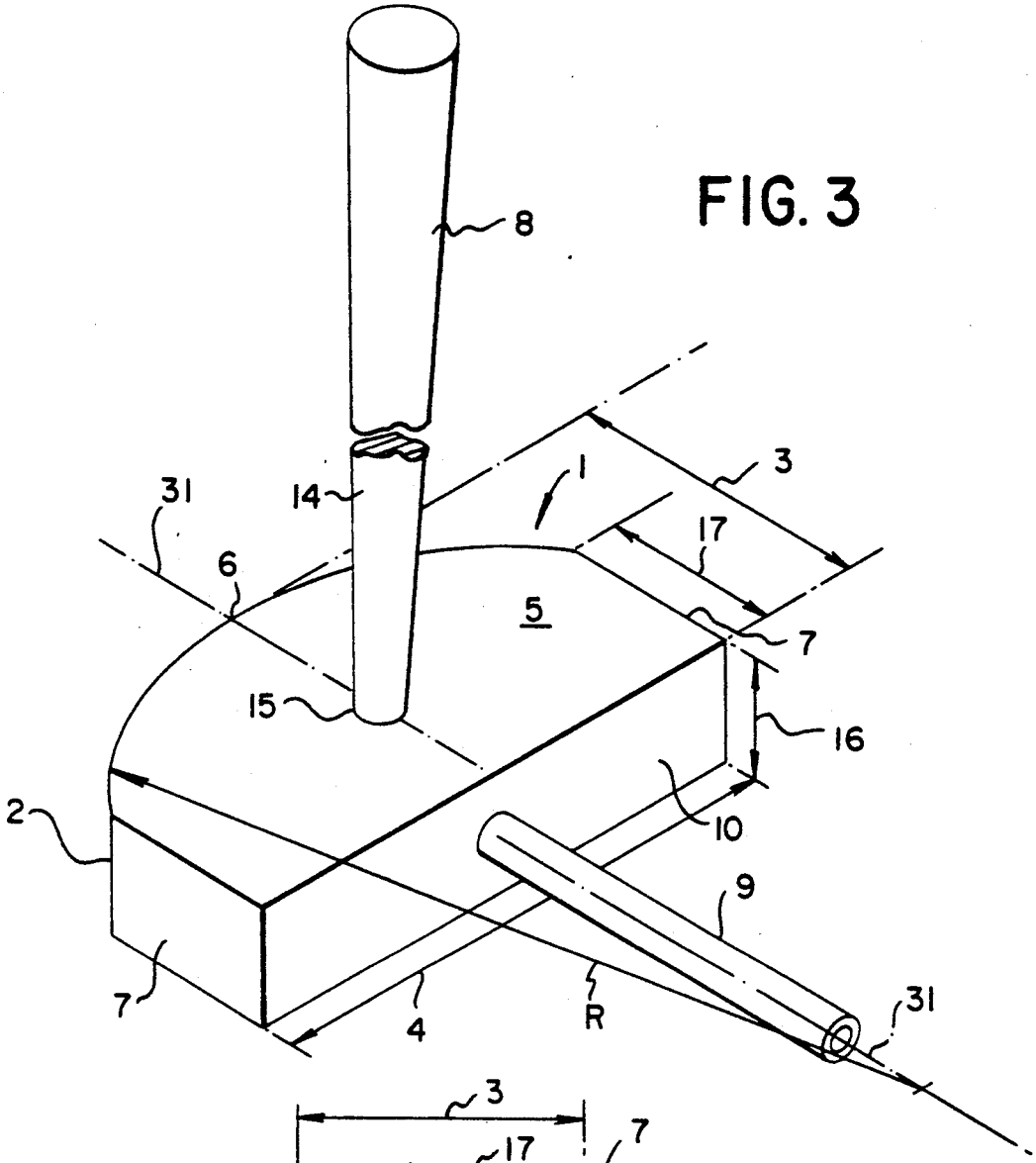
FIG. 3 is a perspective view of a golf putter in accordance with the present invention.
Figure 4:
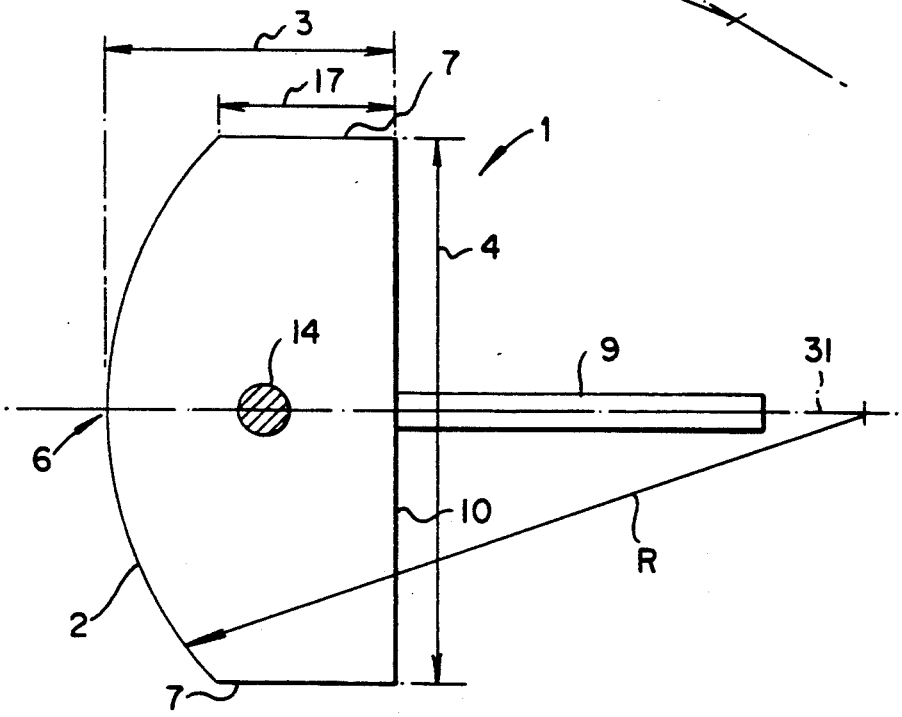
FIG. 4 is a top plan view of the head of the golf putter of FIG. 3.

Referring to FIGS. 3 and 4, a golf putter in accordance with the present invention is shown. The putter head 1 has a front driving face 2 which is convexly curved along the arc of a circle with a radius of curvature R and straight in the vertical direction. The curved surface makes point contact of the putter to the ball at a single point having a tangent which is perpendicular to the correct line of the putt 31. Thus, once the correct line of putt 31 is set, the golfer can rotate the putter in his or her hands and the ball will still travel in the correct line of the putt 31 rather than at an angle. For proper balance, the depth 3 of the putter head 1 from the forward-most point 6 to the rear face 10 should not be more than four inches and is most preferably approximately two inches. The shaft 14 should extend directly upward from and perpendicular to the top surface 5 of the putter head 1. The shaft 14 may be located at any point on the top surface 5 and would be a conventional putter shaft length. However, for optimum balance, the shaft 14 is most preferably located at a point 15 approximately halfway between the forward-most point 6 and the rear face 10. For example, with a depth 3 from the forward-most point 6 to the rear face 10 of about two inches, the distance from the point 6 to the shaft 14 is preferably about 1 inch. A gripping handle 8 is located at the upper end of the shaft 14 and may be constructed of any type of material which allows the golfer maintain a firm grip on the shaft 14.

It has been found that the golf putter of the present invention most effectively compensates for variations in perpendicularity of the driving face 2 to the correct line of the putt 31 when the radius of curvature R of the driving face 2 ranges between 5½–12 inches. With a radius of curvature R of less than 5½ inches, the golfer is less likely to hit the ball correctly because the chances of error become too great if the stroke of the putt deviates from the correct line to the intended target. Where the radius of curvature R is greater than 12 inches, the front driving face 2 begins to resemble a straight line and the attributes of a curved surface are lost.

In addition to eliminating the errors associated with non-perpendicularity, the present invention also provides a means of improving the golfer's ability to ascertain the correct line of putt 31 through the use of a directional alignment aid 9. The directional alignment aid 9 extends outward from and perpendicular to the rear face 10 of the putter head 1 and is generally no greater than 4 inches in length. It can be used to help the golfer to site the correct line of the putt 31 while viewing the hole from a putting stance. Alternatively, when used on a relatively flat green, the directional alignment aid 9 holds the putter in balance so that it will stand alone when placed upright. This enables the golfer to stand behind the putter and view the line of the putt. This feature also assists the golfer in swinging the putter in the correct line of the putt 31 during his back stroke, which is also important in achieving an accurate putt. Yet another function of the directional alignment aid 9 is to provide a balanced distribution of weight on the putter head 1 for a more comfortable stroke.

In a particular preferred embodiment of the invention, the radius of curvature R is approximately 6 inches and the depth 3 is two inches with the shaft being located midway from the forward-most point 6 to the rear face 10. The height 16 of the putter head 1 is 1¼ inches, the length 17 of the end sides 7 is ⅞ inches and the width 4 is 4½. Finally, a direction alignment aid 9 having a length of 3½ inches is used to provide the proper balance.

Because the golf putter of the present invention eliminates errors associated with misalignment of the driving face to the correct line of the putt, a golfer need not try to correct his swing if he or she has a tendency to pronate or supinate his or her wrist at the moment of impact. Thus, a golfer's stroke is natural and, therefore, more comfortable. Moreover, the golfer's mind is eased as to any difficulty in adjusting his or her wrist action to correctly orient the golf ball, and the golfer can concentrate more fully on ascertaining the correct line of the putt. The golfer is further assisted by the directional alignment aid, which allows him or her to concentrate on a fixed line during pre-putt alignment.

Other advantages of the present invention are that the putter head may be manufactured from any type of material, to any desirable finish and by a number of methods which include machining, casting, molding and extruding. The shaft length, type and gripping surface may also be varied according to the personal preference of the user. The putter head is also adaptable for use with shafts of various construction.

Although the invention has been described in considerable detail with respect to preferred embodiments thereof, variations and modifications will be apparent to those skilled in the art, without departing from the spirit and scope of the invention, as set forth in the claims.

We claim:

1. A golf putter comprising:

a putter head having a front driving face which is convexly curved horizontally along an arc of a circle having a radius of curvature of not less than 5½ inches, said driving face being straight in the vertical direction;

a shaft attached to the putter head and extending upwardly therefrom from a point spaced from the driving face by a distance which is less than said radius of curvature; and whereby different parts of the driving face can strike a golf ball and still maintain alignment of the putter to the correct line of travel of a ball to an intended target.

2. A golf putter according to claim 1 wherein said radius of curvature ranges from 5½ to 12 inches.

3. A golf putter according to claim 2 wherein said radius of curvature ranges from 6 to 10 inches.

4. A golf putter according to claim 1 further including a directional alignment aid extending outward from a rear face of said putter head.

5. A golf putter according to claim 4, wherein the aid comprises a bar extending rearwardly from the putter head for a distance of approximately 3 to 4 inches.

6. A golf putter according to claim 4, wherein said alignment aid comprises means for holding the putter in balance so that it will stand alone when placed upright.

7. A golf putter according to claim 1, wherein the shaft is attached to the putter head midway between the forward-most point of the driving face and a rear face of the putter head.

8. A golf putter according to claim 7, wherein the depth of the putter head from the forward-most point of the driving face to the rear face of the putter head is approximately 2 inches.

9. A golf putter comprising:

a putter head having a front driving face which is convexly curved horizontally along an arc of a circle having a radius of curvature of substantially six inches said driving face being straight in the vertical direction, the putter head having a rear face located substantially two inches from the forward-most point of the driving face, and a shaft attached to the putter head midway from said forward-most point to said rear face; and whereby different parts of the driving face can strike a golf ball and still maintain alignment of the putter to the correct line of travel of a ball to an intended target.

10. A golf putter according to claim 9, including an alignment aid in the form of a bar extending rearwardly from said rear face, parallel to the intended line of travel to the intended target.

* * * * *